United States Patent [19]

Finnan

[11] Patent Number: 4,495,987

[45] Date of Patent: Jan. 29, 1985

[54] TUBE AND TUBE SHEET ASSEMBLY

[75] Inventor: Marshall N. Finnan, Santa Ana, Calif.

[73] Assignee: Occidental Research Corporation, Los Angeles, Calif.

[21] Appl. No.: 467,726

[22] Filed: Feb. 18, 1983

[51] Int. Cl.[3] ..... F28F 9/16

[52] U.S. Cl. ..... 165/70; 29/421 E; 165/173; 165/174

[58] Field of Search ..... 165/174, 70, 134 R, 165/134 DP, 173, 175, 76; 29/421 E

[56] References Cited

U.S. PATENT DOCUMENTS

| | | | |
|---|---|---|---|
| 2,834,581 | 5/1958 | Schefek et al. | 165/134 R |
| 2,986,454 | 5/1961 | Jewett | 165/134 R |
| 3,717,925 | 2/1973 | Hardwick | 165/173 |
| 3,727,681 | 4/1973 | Fernandes | 165/174 X |
| 3,782,450 | 1/1974 | Swozil | 165/173 |
| 4,252,182 | 2/1981 | Fender | 165/134 R |

FOREIGN PATENT DOCUMENTS

| | | | |
|---|---|---|---|
| 657100 | 5/1929 | France | 165/174 |
| 1222655 | 6/1960 | France | 165/174 |
| 608310 | 9/1960 | Italy | 165/174 |
| 387204 | 10/1973 | U.S.S.R. | 165/134 R |

*Primary Examiner*—Sheldon J. Richter

*Attorney, Agent, or Firm*—Christie, Parker & Hale

[57] ABSTRACT

A tube and tube sheet assembly for a heat exchange device includes a plurality of heat exchanger tubes extending through a first and second tube sheet to provide a fluid-type passageway therebetween to enable a cooling fluid to be passed between the first and second tube sheets to reduce flashing of fluid introduced to the tubes. The fluid may be introduced into the tubes through the first tube sheet without turbulence or flashing because a smooth, continuous transition is provided therebetween by explosively forming the tubes within the tube sheet and providing openings communicating with each of the holes which are defined by the surface of revolution of an arc extending outwardly from the circumference of each hole to prevent formation of a Vena Contracta.

18 Claims, 2 Drawing Figures

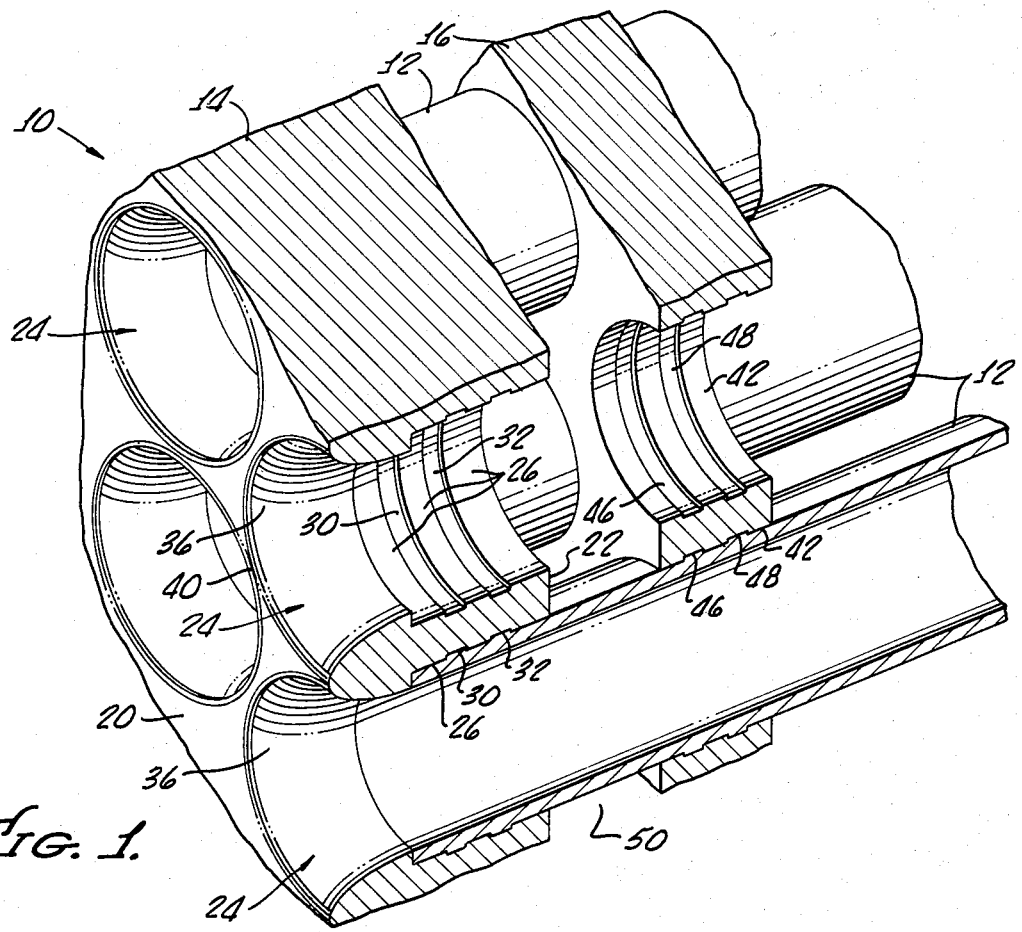
FIG. 1.
FIG. 2.
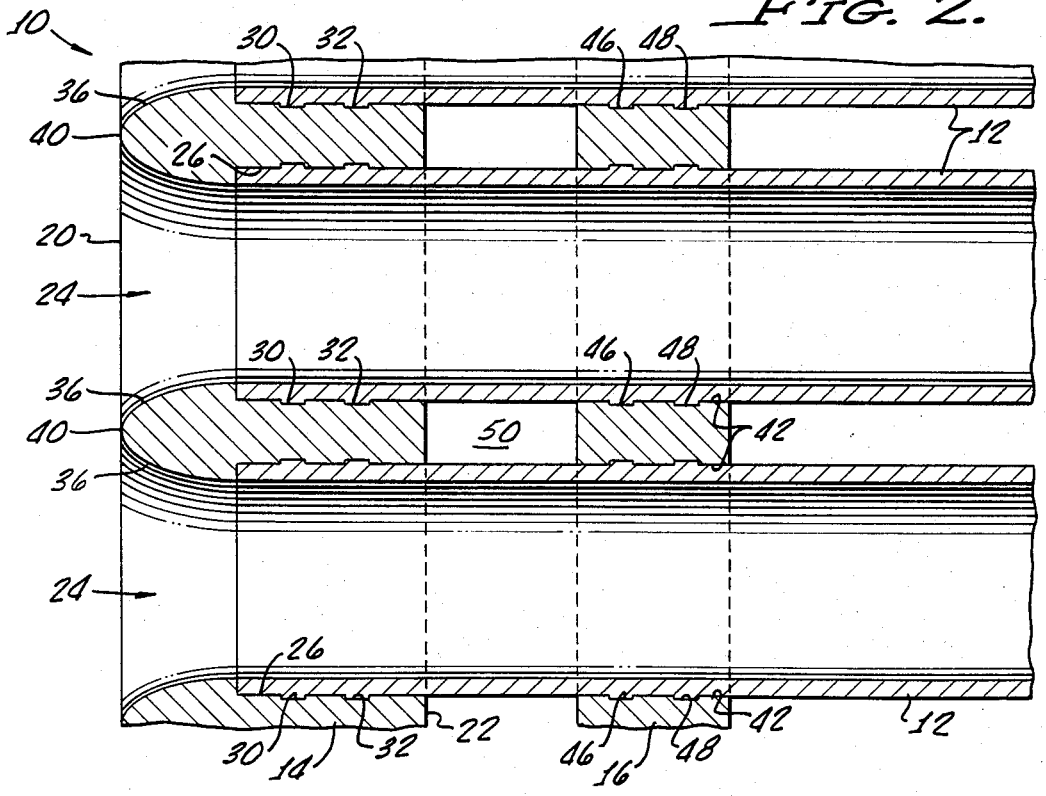

TUBE AND TUBE SHEET ASSEMBLY

BACKGROUND

The present invention is directed to heat exchanger-evaporator devices useful for both liquid and gases, and more particularly is directed to a tube and tube sheet assembly for a heat exchanger device which substantially reduces the amount of turbulence in fluids passing therethrough resulting in reduced wear and erosion of the tube sheet and the tube entrance, thereby prolonging the useful life of the heat exchange device.

In many chemical processes using an evaporator-exchanger, significant erosion occurs at the tube entrance, both within the tubes and the tube sheets supporting the tubes. For example, in a superphosphoric acid evaporator, buildup of scale is known to occur on the tube sheet and tube entrance. This scale buildup occurs as a result of flashing of the superphosphoric acid at the tube entrance which is caused, in part, by the pressure drop and turbulence occurring at the entrance of the evaporator. The scale buildup can be significant, and requires the evaporator to be shut down for descaling of the buildup by either flushing a different solution through the evaporator-exchanger, such as a dilute sulfuric acid, or disassembling the evaporator-exchanger for manually removing the scale.

It is apparent that these descaling procedures interrupt the continuous use of the evaporator and usually remove additional metal from the tube and tube sheet assembly, thereby hastening the mechanical failure thereof. Many attempts have been made to reduce the turbulence of fluids passing through a heat exchanger or evaporator which include the removal of discontinuities occurring in the tube and tube sheet assembly, such as cutting the tubes so that the ends thereof are flush with the tube sheet, and using inserts, which may be formed of plastic, positioned in the openings of the tubes at the tube sheet face, in order to provide a smooth "trumpet" like entry into the tubes. Such inserts have been used to reduce the velocity change from outside the tube sheet to inside the tubes themselves. These inserts, however, may incite further turbulence. Further, they are subject to being dislodged and thereafter blocking the flow of fluid through portions of the heat exchanger, thereby disrupting the flow therethrough and reducing the efficiency of the heat exchanger.

Mechanical failure of an evaporator may be primarily caused by erosion of the tube and tube sheet assembly. Even with very corrosive materials such as superphosphoric acid, the amount of corrosion occurring in an evaporator-exchanger constructed from a corrosion-resistant metal, such as Hastalloy G3, has been found to be only 20% of the tube metal loss. The majority of tube metal loss is caused by entry velocity erosion and removal of the metal during descaling operations.

The present invention enables a liquid or gas to enter the tubes of an evaporator, or heat exchanger, with minimal turbulence, thereby reducing wear and erosion of the heat exchanger tubes at the entrance in the tube exchanger sheet, as well as the tube sheet itself. Since the entry pressure drop of the present invention may be 1/10 of the drop experienced by existing tube and tube sheet assemblies, there is a significant reduction in flashing occurring in the tube entrance which significantly reduces the amount of deposit or scale formation and enables an increase of up to 80% in operating time during an operating cycle because descaling operations are reduced. Because the operating time of the heat exchanger or evaporator is significantly increased, the overall operating cost is reduced. Further, the present invention enables the tube and tube sheet assembly to be cooled proximate the tube sheet to further reduce flashing of entering fluid, thereby additionally reducing fluid flashing.

SUMMARY OF THE INVENTION

In accordance with the present invention, the tube and tube sheet assembly for a heat exchange device includes a plurality of heat exchanger tubes and a tube sheet having a front and a back face, and means defining a plurality of holes therein. Each of the holes corresponds to one of the heat exchange tubes and communicates with a reamed portion of the tube sheet back face which is sized for the insertion of the corresponding heat exchanger tube. At least one groove in a wall of the reamed portion is provided to enable a portion of the corresponding tube to flow thereinto upon explosive forming of the tube after insertion of the tube into the reamed portion. Use of explosive forming enables the tube to be fixed into the tube sheet without welding or rolling the tube into the tube sheet. The tube inside diameter after explosive forming is the same diameter as the hole diameter to provide a smooth, continuous transition therebetween. This is to be contrasted with a tube and tube sheet assembly which is manufactured by welding or rolling the tube sheets therein, which typically either distorts the inside diameter of the tubes or provides rough edges at their entrance which contributes to turbulence of the fluid passing therethrough.

The tube sheet front face has means defining an opening communicating with each of the holes with each of the openings being defined by the surface of revolution of an arc extending outwardly from the circumference of the hole.

More particularly, the arc may be elliptical in curvature and the means defining an opening communicating with each of the holes further defines a curved surface interconnecting adjacent holes having an elliptic curvature along the plane defined by the axes of adjacent holes.

A second tube sheet may be provided having means defining a plurality of holes therein with each hole corresponding to one of the heat exchanger tubes. The second tube sheet is disposed in a spaced-apart relationship with the first tube sheet with the heat exchanger tubes extending through the second tube sheet and sealed thereto to define a fluid-type passageway between the first and second tube sheets outside of the heat exchanger tubes. This enables a cooling fluid to be passed between the first and second tube sheets to cool portions of the heat exchanger tubes passing therebetween for reducing the amount of flashing of the fluid introduced into the tube and tube sheet assembly.

BRIEF DESCRIPTION OF THE DRAWINGS

The advantages and features of the present invention will be better understood by the following description taken in conjunction with the accompanying drawings, in which:

FIG. 1 is a perspective view of a tube and tube sheet assembly in accordance with the present invention, generally showing a plurality of heat exchanger tubes and a tube sheet with openings communicating with the tubes which are defined by the surface of revolution of an arc extending outwardly from the circumference of each hole into which the tubes are inserted; and, FIG. 2 is a cross-sectional view of the tube and tube sheet assembly in accordance with the present invention showing a second tube sheet in a spaced-apart relationship with the tube sheet shown in FIG. 1 for providing a fluid-type passageway between the first and second tube sheets outside of the heat exchanger tubes for enabling cooling fluid to be passed over the heat exchanger tubes between the first and second tube sheets.

DETAILED DESCRIPTION

Referring to both FIGS. 1 and 2, a tube and tube sheet assembly 10 in accordance with the present invention includes a plurality of heat exchanger tubes 12, a first tube sheet 14, and a second tube sheet 16. It should be appreciated that the number and size of the tubes 12 are dependent upon the application for which the heat exchange device is to be used. As an example, the tube and tube sheet assembly partially shown in FIGS. 1 and 2 may include up to 850 tubes of 1¼ inch diameter with a ⅛ inch wall, and for application for evaporating phosphoric acid solution may be formed of Hastalloy G3 or the like. The tube sheet 14 may be up to 6 feet in diameter, approximately 2 inches thick and formed from Inconel 625, or Hastalloy G3, for corrosion resistance.

The tube sheet 14 includes a front face 20 and a back face 22 with a plurality of holes 24, each corresponding to one of the heat exchanger tubes and communicating with a reamed portion 26 of the tube sheet back face 22. The reamed portion 26 is sized for insertion of the corresponding heat exchanger tube 12 and communicates with grooves 30, 32 in the reamed portion. The size of the reamed portion is determined in accordance with the well-known process of explosive forming of the tubes within the reamed portion to secure the tubes 12 into the tube sheet 14.

In the explosive forming technique a detonating cord, not shown, is inserted into the tubes 12 after their placement into the tube sheet 14 and exploded to set and seal the tubes in the tube sheet 14. The technique is well known and provides a uniform and complete kinetic expansion of the tubes into the tube sheet without metallurgical damage characteristic of roller-expansion methods.

Upon explosive forming of the tube into the tube sheet, a portion of the corresponding tube 12 flows into the grooves 30, 32 to securely fasten the tube and the tube sheet together. By proper sizing of the reamed portion, the tube inside diameter is the same as the hole diameter after explosive forming, which provides a smooth, continuous transition therebetween. This smooth, continuous transition facilitates the flow of fluid therethrough without introducing turbulence into the fluid flow.

The tube sheet front face 20 is machined in order to create openings 36 communicating with each of the holes, each of the openings 36 being preferably defined by a surface of revolution of a parabolic, or elliptical, arc extending outwardly from the circumference of each hole. In addition, the holes 24 are spaced apart from one another so that the curved surface 40 between the holes 24 has a parabolic, or elliptical, curvature along a plane defined by the axes of adjacent holes 24. This is best seen in FIG. 2.

Referring to FIG. 2, the second tube sheet 16 includes means defining a plurality of holes 42 with each hole corresponding to one of the heat exchanger tubes 12. The second tube sheet 16 may be formed from a one-inch plate of Inconel 625 and is disposed in a spaced-apart relationship with the first tube sheet 14 with heat exchanger tubes 12 extending through the second tube sheet 16. While the spacing between the first and second tube sheets 14, 16 may vary with the amount of fluid to be passed therethrough, a one-inch spacing is contemplated in the present invention.

Similar to the first tube sheet 14, grooves 46, 48 may be formed in the second tube sheet 16 and communicate with the holes 42 in order that the tubes 12 may be explosively formed therein to provide a fluid-type passageway 50 between the first and second tube sheets and outside of the heat exchanger tubes 12 for enabling cooling fluid to be passed between the first and second tube sheets to cool a portion 52 of the tube sheet 12 passing between the tube sheets 14, 16, as well as the first tube sheet 14.

When used in an evaporator, fluid passing through the tubes is heated so as to enable the fluid to boil or evaporate as it leaves the heat exchanger. Under these conditions, the fluid introduced into the tubes 12 may flash even though the present provisions of a smooth end are provided by this invention. In this instance, cooling fluid may be passed between the first and second tube sheets to cool the first tube sheet 14 as well as the portion 52 of tube passing between the first and second tube sheets in order to reduce such flashing. In this manner, the fluid introduced into the evaporator is more gradually heated than otherwise provided with a single tube sheet and the possibility of flashing is further reduced.

Although there has been described hereinabove a specific arrangement of a tube and tube sheet assembly in accordance with the invention for purposes of illustrating the manner in which the invention may be used to advantage, it should be appreciated that the invention is not limited thereto. Accordingly, any and all modifications, variations or equivalent arrangements which may occur to those skilled in the art should be considered to be within the scope of the invention as defined in the appended claims.

What is claimed is:

1. A tube and tube sheet assembly for a heat exchange device comprising:

a plurality of heat exchanger tubes; and a tube sheet having a front and a back face and means defining a plurality of generally circular holes therein, each hole corresponding to one of the heat exchanger tubes and communicating with a reamed portion of the tube sheet back face, said reamed portion being sized for insertion of the corresponding heat exchanger tube and communicating with at least one groove in a wall of the reamed portion to enable a portion of the corresponding tube to flow thereinto upon explosive forming of the tube after insertion of the tube into the reamed portion, the hole diameter being of the same diameter as the tube inside diameter after explosive forming to provide a smooth, continuous transition therebetween, said tube sheet front face having means defining an opening communicating with each of said holes, each said opening having a convex surface defined by the surface of revolution of an arc extending outwardly from the circumference of each hole said last mentioned means further defining a smooth continuous curved surface interconnecting adjacent holes.

2. The tube and sheet assembly of claim 1 wherein said arc is parabolic in curvature.

3. The tube and sheet assembly of claim 1 wherein said arc is elliptical in curvature.

4. The tube and sheet assembly of claim 1 wherein the curved surface interconnecting adjacent holes has a parabolic curvature along a plane defined by the axes of the adjacent holes.

5. The tube and sheet assembly of claim 1 wherein the curved surface interconnecting adjacent holes has an elliptic curvature along a plane defined by the axes of the adjacent holes.

6. A tube and tube sheet assembly for a heat exchange device comprising:

a plurality of heat exchanger tubes; and a tube sheet having a front and back face and means defining a plurality of generally circular holes therein, each hole corresponding to one of the heat exchanger tubes and communicating with a reamed portion of the tube sheet back face, said reamed portion being sized for insertion of the corresponding heat exchanger tube and communicating with at least one groove in a wall of the reamed portion to enable a portion of the corresponding tube to flow thereinto upon explosive forming of the tube after insertion of the tube into the reamed portion, the hole diameter being of the same diameter as the tube inside diameter after explosive forming to provide a smooth, continuous transition therebetween, said tube sheet front face having means defining an opening communicating with each of said holes, each said opening having a convex surface defined by the surface of revolution of a parabolic arc extending outwardly from the circumference of each hole, said last mentioned means further defining a curved surface interconnecting adjacent holes having a parabolic curvature along a plane defined by the axes of the adjacent holes.

7. A tube and tube sheet assembly for a heat exchange device comprising:

a plurality of heat exchanger tubes;

a first tube sheet having a front and a back face and means defining a plurality of generally circular holes therein, each hole corresponding to one of the heat exchanger tubes and communicating with a reamed portion of the tube sheet back face, said reamed portion being sized for insertion of the corresponding heat exchanger tube and communicating with at least one groove in a wall of the reamed portion to enable a portion of the corresponding tube to flow thereinto upon explosive forming of the tube after insertion of the tube into the reamed portion, the hole diameter being of the same diameter as the tube inside diameter after explosive forming to provide a smooth, continuous transition therebetween, said tube sheet front face having means defining an opening communicating with each of said holes, each said opening having a convex surface defined by the surface of revolution of an arc extending outwardly from the circumference of each hole, said last mentioned means further defining a smooth continuous curved surface interconnecting adjacent holes; and a second tube sheet having means defining a plurality of holes therein, each hole corresponding to one of the heat exchanger tubes, said second tube being disposed in a spaced-apart relationship with said first tube sheet with the heat exchanger tubes extending through the second tube sheet and sealed thereto to define a fluid tight passageway means between the first and second tube sheets outside of said heat exchanger tubes for enabling cooling fluid to be passed between the first and second tube sheets to cool portions of the heat exchanger tubes passing therebetween and the first tube sheet.

8. The tube and sheet assembly of claim 7 wherein said arc is parabolic in curvature.

9. The tube and sheet assembly of claim 7 wherein said arc is elliptical in curvature.

10. The tube and sheet assembly of claim 7 wherein the curved surface interconnecting adjacent holes has a parabolic curvature along a plane defined by the axes of the adjacent holes.

11. The tube and sheet assembly of claim 7 wherein the curved surface interconnecting adjacent holes has an ellipitic curvature along a plane defined by the axes of the adjacent holes.

12. A tube and tube sheet assembly for a superphosphoric acid evaporator comprising:

a plurality of heat exchanger tubes formed of material resistant to corrosion by superphosphoric acid; and a tube sheet formed of material resistant to corrosion by superphosphoric acid, having a front and a back face and means defining a plurality of generally circular holes therein, each hole corresponding to one of the heat exchanger tubes and communicating with a reamed portion of the tube sheet back face, said reamed portion being sized for insertion of the corresponding heat exchanger tube and communicating with at least one groove in a wall of the reamed portion to enable a portion of the corresponding tube to flow thereinto upon explosive forming of the tube after insertion of the tube into the reamed portion, the hole diameter being of the same diameter as the tube inside diameter after explosive forming to provide a smooth, continuous transition therebetween, said tube sheet front face having means defining an opening communicating with each of said holes, each said opening having a convex surface defined by the surface of revolution of a parabolic arc extending outwardly from the circumference of each hole, said last mentioned means further defining a smooth continuous curved surface interconnecting adjacent holes having a parabolic curvature along a plane defined by the axes of the adjacent holes; and a second tube sheet having means defining a plurality of holes therein, each hole corresponding to one of the heat exchanger tubes, said second tube sheet being disposed in a spaced-apart relationship with said first tube sheet with the heat exchanger tubes extending through the second tube sheet and sealed thereto to define a fluid tight passageway means between the first and second tube sheets outside of said heat exchanger tubes for enabling cooling fluid to be passed between the first and second tube sheets to cool portions of the heat exchanger tubes passing therebetween and the first tube sheet.

13. A tube and tube sheet assembly for a heat exchange device comprising:

a plurality of heat exchanger tubes; and a tube sheet having a front and a back face and means defining a plurality of adjacent generally circular holes therein, each hole corresponding to one of the heat exchanger tubes and communicating with a reamed portion of the tube sheet back face, said reamed portion being sized for insertion of the corresponding heat exchanger tube and communicating with at least one groove in a wall of the reamed portion to enable a portion of the corresponding tube to flow thereinto upon explosive forming of the tube after insertion of the tube into the reamed portion, the hole diameter being of the same diameter as the tube inside diameter after explosive forming to provide a smooth, continuous transition therebetween, said tube sheet front face having means defining an opening communicating with each of said holes, each said opening being defined by the surface of revolution of an arc extending outwardly from the circumference of each hole, said means defining an opening communicating with each of said adjacent generally circular holes further defining a smooth continuous curved surface interconnecting adjacent generally circular holes.

14. A tube and tube sheet assembly for a superphosphoric acid evaporator comprising:

a plurality of heat exchanger tubes formed of material resistant to corrosion by superphosphoric acid; and, a tube sheet formed of material resistant to corrosion by superphosphoric acid, having a front and a back face and means defining a plurality of generally circular holes therein, each hole corresponding to one of the heat exchanger tubes and communicating with a reamed portion of the tube sheet back face, said reamed portion being sized for insertion of the corresponding heat exchanger tube and communicating with at least one groove in a wall of the reamed portion to enable a portion of the corresponding tube to flow thereinto upon explosive forming of the tube after insertion of the tube into the reamed portion, the hole diameter being of the same diameter as the tube inside diameter after explosive forming to provide a smooth, continuous transition therebetween, said bute sheet front face having means for reducing erosion of the tube sheet front face by the superphosphoric acid and preventing the build up of scale thereon, said last mentioned means defining an opening communicating with each of said holes, each said opening having a convex surface defined by the surface of revolution of an arc extending outwardly from the circumference of each hole said last mentioned means further defining a smooth continuous curved surface interconnecting adjacent holes.

15. The tube and sheet assembly of claim 14 wherein said arc is parabolic in curvature.

16. The tube and sheet assembly of claim 14 wherein said arc is elliptical in curvature.

17. The tube and sheet assembly of claim 14 wherein the curved surface interconnecting adjacent holes has a parabolic curvature along a plane defined by the axes of the adjacent holes.

18. The tube and sheet assembly of claim 14 wherein the curved surface interconnecting adjacent holes has an alliptic curvature along a plane defined by the axes of the adjacent holes.

* * * * *

UNITED STATES PATENT AND TRADEMARK OFFICE

CERTIFICATE OF CORRECTION

PATENT NO. : 4,495,987

DATED : January 29, 1985

INVENTOR(S) : Marshall N. Finnan

It is certified that error appears in the above-identified patent and that said Letters Patent is hereby corrected as shown below:

Column 3, line 2, after "and" delete the comma; Column 4, line 66, after "hole" insert --,--; Column 4, line 67, after "smooth" insert --,--; Column 5, line 62, after "smooth" insert --,--; Column 5, line 66, after "tube" insert --sheet--; Column 6, line 45, after "smooth" insert --,--; Column 7, Claim 13, line 17, after "smooth" insert --,--; Column 7, Claim 14, line 24, after "and" delete the comma; Column 8, Claim 14, line 8, change "bute" to --tube--; Column 8, Claim 14, line 11, change "build up" to --buildup--; Column 8, Claim 14, line 16, after "hole" insert --,--; Column 8, Claim 14, line 17, after "smooth" insert --,--; Column 8, Claim 18, line 30, change "alliptic" to --elliptic--.

Signed and Sealed this

*Twenty-fourth* Day of *September 1985*

[SEAL]

*Attest:*

*Attesting Officer*

DONALD J. QUIGG

*Commissioner of Patents and Trademarks—Designate*